US006626599B2

(12) United States Patent
De Laforcade

(10) Patent No.: US 6,626,599 B2
(45) Date of Patent: Sep. 30, 2003

(54) DEVICE FOR APPLYING A PRODUCT TO A SECTION OF HAIR

(75) Inventor: Vincent De Laforcade, Rambouillet (FR)

(73) Assignee: L'Oreal S.A., Paris (FR)

( * ) Notice: Subject to any disclaimer, the term of this patent is extended or adjusted under 35 U.S.C. 154(b) by 0 days.

(21) Appl. No.: 09/733,052

(22) Filed: Dec. 11, 2000

(65) Prior Publication Data

US 2002/0012562 A1 Jan. 31, 2002

(30) Foreign Application Priority Data

Dec. 9, 1999 (FR) ..... 99 15544

(51) Int. Cl.[7] ..... A46B 11/00; B05C 21/00; A61K 7/13

(52) U.S. Cl. ..... 401/10; 401/9; 401/207; 401/196; 132/208; 132/108; 132/270; 132/221

(58) Field of Search ..... 401/9, 10, 196, 401/203, 207, 261; 132/208, 108, 221, 270

(56) References Cited

U.S. PATENT DOCUMENTS

| | | | | |
|---|---|---|---|---|
| 1,978,716 | A | * | 10/1934 | Morehouse |
| 3,030,968 | A | | 4/1962 | Oberstar et al. |
| 3,056,998 | A | * | 10/1962 | Ebner |
| 3,109,192 | A | * | 11/1963 | Levenson |
| 3,468,318 | A | | 9/1969 | Cook et al. |
| 3,805,810 | A | * | 4/1974 | Savala |
| 4,144,897 | A | * | 3/1979 | Mosz |
| 4,385,638 | A | * | 5/1983 | Hasegawa |
| 4,517,702 | A | * | 5/1985 | Jackson |
| 4,727,893 | A | | 3/1988 | Goncalves |
| 4,830,030 | A | * | 5/1989 | Busch et al. |
| 4,942,893 | A | | 7/1990 | Trottier |
| 5,022,493 | A | * | 6/1991 | Buckelew |
| 5,676,480 | A | * | 10/1997 | Tosto |
| 6,062,231 | A | | 5/2000 | De Laforcade |

FOREIGN PATENT DOCUMENTS

| | | | | |
|---|---|---|---|---|
| CH | 287 396 | | 4/1953 | |
| DE | 662702 | * | 6/1938 | ..... 401/10 |
| DE | 3118196 | * | 12/1982 | ..... 401/10 |
| FR | 1 529 483 | | 10/1968 | |
| FR | 2 589 337 | | 5/1987 | |
| FR | 2 764 488 | | 12/1998 | |

OTHER PUBLICATIONS

English Language translation of CH 287 396.

Co–pending Application Attorney Docket No. 05725.1067–00000 Title: Device for Applying a Hair Product to Sections of Hair and Method of Hair Treatment Inventor: Vincent De LaForcade U.S. Filing Date: Jun. 10, 2002.

* cited by examiner

*Primary Examiner*—David J. Walczak

(74) *Attorney, Agent, or Firm*—Finnegan, Henderson, Farabow, Garrett & Dunner, LLP

(57) ABSTRACT

An application device for applying a hair product, especially a dye product, to sections of hair. The device comprises a component made of at least one elastically deformable material and a reservoir for containing a product. The component at least partly defines a slot which communicates with the reservoir and is accessible from the outside of the device. The slot is bounded by edges which, at rest, are positioned substantially contiguous to each other so as to create a seal. A section of hair is able to pass through the slot so as to allow the section of hair to be coated with the product in response to movement of the device in a longitudinal direction with respect to the section of hair.

54 Claims, 4 Drawing Sheets

DEVICE FOR APPLYING A PRODUCT TO A SECTION OF HAIR

DESCRIPTION OF THE INVENTION

The present invention relates to a device for applying a product, especially a liquid-to-viscous product, to a section of hair, and to a method of hair treatment using this device. The invention is most particularly suitable for applying a hair dye product onto hair section by section. The device of the invention may serve for any other hair treatment, such as hair perming, conditioning or other specific treatments. The invention is particularly advantageous for applying a relatively liquid product under clean conditions. However, the product to be applied can be in the form of a cream, a gel or a liquid of relatively high viscosity.

In the case of a hair dye product, hair dyes are typically taken up from a bowl. Such dyes are intended either for overall use, called "whole head" use, in which the hair is completely impregnated with the product for the purpose of modifying the colour of all of it, or for partial use, called use "in sections," in which only certain parts of the hair are impregnated with product so as to obtain, once the treatment has been completed, a non-homogeneous or streaked color effect, thus emphasizing a particular movement of the hair with lighter or darker shades of color than the natural or overall shade of the hair.

FR-A-2,589,337 describes a device for applying a hair dye comprising, firstly, a bottle storing the product to be applied and, secondly, an applicator head fitted to the bottle. The applicator head has an orifice for supplying the product and bears, at its free end, a two-tined fork that the user can guide from one end of a section of hair to the other, when the hair section is placed between the two tines of the fork, for the purpose of applying the product to the section of hair. The space separating the two tines opens directly at their base into an open cavity in which the product accumulates, into which space the supply orifice emerges. This cavity is bounded on its open face by a moveable flap capable of exposing the cavity for the purpose of cleaning the application head easily.

Another type of device for applying a hair product in sections is described in FR-A-2,764,488. This device includes a tip for isolating a given section of hair, and applicator means for dipping into a hair product. The applicator means includes at least one row of teeth. The hair product is applied to the isolated section of hair by bringing the section of hair into contact with the applicator means and by moving the applicator means relative to the section of hair from the point of initial contact towards a free end of the section of hair. Receiving means are provided for keeping the section of hair in application contact with the applicator means throughout their movement.

Other types of devices for applying a hair product in sections are in the form of a comb having, inside, supply channels communicating with a product reservoir. These supply channels open out to the tips of the tines of the comb or to the spaces separating the tines.

Such devices generally suffer from the same drawbacks due to the fact that, in particular, they have an open structure. As a result, because of this structure, the product retained on the applicator means has a tendency to run, especially when the product is relatively liquid. Furthermore, because the hair to be treated does not form a planar surface, the user often needs to change the orientation of the application device depending on the area to be treated. Such an operation also increases the risk of the product running in undesirable areas. In addition, certain applicators of this kind have the drawback of a relatively short autonomy.

Another type of applicator of the section type is described in U.S. Pat. No. 4,942,893. With this type of applicator, the part of the hair to be dyed is introduced into a sealed capsule containing a dye product. The section or sections of hair are held in the capsule throughout the time needed for the dye product to act. This type of applicator is well suited for applying products requiring a certain laying time but it is not at all suitable for the aforementioned dyeing in sections.

One of the objectives of the invention is therefore to provide a device for applying a hair product to sections of hair, which does not have the drawbacks mentioned above with reference to the devices of the prior art.

It is in particular an objective of the invention to provide a device allowing a hair product to be applied in a clean and non-sullying manner, and to do so whatever the viscosity of the product to be applied.

Furthermore, it is an aim of the invention to provide a device which has an advantageous manufacturing cost.

It is another object of the invention to provide a device allowing a hair product to be applied, which is simple to use and which allows the product to be applied over the entire length of the section of hair, from the root to its free end, or conversely, from the free end to the root. The application device of the invention is particularly suitable for use at home, either by the consumer himself or by a third person not having any specific experience in hair dyeing.

Although the invention preferably has one or more of the above-mentioned objects and advantages, certain aspects of the invention could be practiced without necessarily accomplishing one or more of the objects and advantages.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

In one aspect, the invention includes a device for applying a hair product, for example a dye product, to sections of hair, the device comprising a component made of at least one elastically deformable material and at least partly defining a reservoir for the product, wherein the component also at least partly defines a slot which communicates with the product reservoir and opens onto the outside of the device, the slot being bounded by two edges which, at rest, are substantially contiguous over at least one portion of the slot so as to create a seal, wherein a section of hair is able to pass through the slot so as to allow the section of hair to be coated with the product in response to movement of the device in a longitudinal direction with respect to the section of hair.

It is clearly understood that the intended seal, within the context of the present application, is understood to mean a seal or quasi-seal relative to a given composition. It is clear that the conditions for obtaining such a seal (in particular, the density of the elastic material, the relative bearing of the edges defining the slot) vary according to the viscosity of the product. Likewise, such a seal corresponds to a seal under normal conditions of use, particularly with regard to the lifetime of the device.

This arrangement allows the section of hair to be brought into contact with the product, continuously, over all or part of its length, and without appreciable flow of product out of the reservoir. For this purpose, the user takes hold of a precise section of hair, which preferably is as thin as possible, and positions it in the slot. The movement is simple and precise and makes it possible for the desired dyeing of hair in sections to be carried out rapidly over all or part of its length. During application, the seal is provided whatever the position of the application device. Any outflow of product is almost impossible when the elasticity of the elastically deformable component which defines the slot is chosen appropriately. In addition, the risk of the product coming into contact with the user's hands is markedly reduced.

Furthermore, while allowing relative movement of the component partly defining the slot along the section of hair, the component prevents substantially any movement which would lead to its contact with all or part of the section during the treatment being broken. The section of hair is thus kept in the slot during the treatment. With such a configuration, the section is "pinched" between two parts of the device, without being gripped too tightly, so as to allow the device to slide along the section from one of its ends to the other. Thus, throughout the movement of the device a portion of the section of hair is impregnated with product.

Advantageously, the elastically deformable component is designed so that the section of hair, when passing through the slot, also passes through the product reservoir.

According to one particularly simple embodiment, one of the two edges defining the slot is defined by a portion of an enclosure which is made of a material impermeable to the product. The component made of elastically deformable material is disposed in the enclosure, the enclosure having an opening to permit access to the slot from outside the device. Preferably, the opening in the enclosure is bounded by guide members shaped to guide insertion of the section of hair into the device.

According to another particularly preferred embodiment, the two edges of the slot are formed by the component made of elastically deformable material. In this case, a first edge of the slot may be formed by a first part of the component made of a first elastically deformable material. The second edge of the slot is formed by a second part of the component and is made of a second elastically deformable material. The reservoir may be sealed with respect to the outside even with sections of hair having a large volume, and without any risk of the product flowing out of the reservoir to the outside, whatever the position of the application device. For this purpose, the two parts of the component are advantageously mounted so as to exert a suitable compressive force between the first and second edges. Thus, the slot edges are made substantially contiguous. In addition, a relatively wide section may be held between the edges.

This arrangement has another advantage since, because of the elastic compressive force exerted between the first and second edges of the slot, wiping of the section of hair occurs during the treatment. In this way, any excess product deposited on the section of hair in the reservoir is removed before the section leaves the slot and is retained within the device. Thus, a section of hair already impregnated with product cannot cause, by being brought into contact with an untreated part of the hair, undesirable dyeing of the untreated hair.

Preferably, the elastically deformable materials are chosen from the group of elastomers chosen from ethylene-propylene copolymers; polyether-block-amides; polyvinyls; ethylene-propylene-diene terpolymers (EPDM); styrene-butadiene-styrene block copolymers (SBS); styrene-ethylene butylene-styrene/styrene-isoprene-styrene block copolymers (SEBS-SIS); thermoplastic polyurethanes; blends of polypropylene with styrene-ethylene butylene-styrene/styrene-isoprene-styrene block copolymers (SEBS-SIS); blends of polypropylene with ethylene-propylene-diene terpolymers (EPDM); and blends of polypropylene with styrene-butadiene-styrene block copolymers (SBS).

Preferably, the slot extends over an opening angle of from 20° to 320°, and more preferably from 120° to 200°. The slot may be partially produced in the elastically deformable component, for example, by mechanical cutting (using a knife) or thermal cutting (using a laser). Advantageously, the slot is produced over a depth of approximately 1 mm to approximately 20 mm, and preferably approximately 3 mm to approximately 8 mm.

Advantageously, the two edges of the slot are accessible from the outside of the component made of elastically deformable material, the two edges of the slot being flared with respect to one another to define an open portion. Thus, the insertion of the section of hair into the slot is facilitated.

According to one embodiment, the product reservoir is bounded, at least partly, by a hollowed-out portion of the component made of elastically deformable material.

Thus, the component made of elastically deformable material may form, for example, a cylinder whose center is hollowed out so as to form the product reservoir.

According to another embodiment, the product reservoir is formed inside the actual structure of the material forming the elastically deformable component, especially open or semi-open cells of the material which intercommunicate multidirectionally. In this case, it is possible to produce the component made of elastically deformable material in the form of a solid cylinder and it is the cylinder itself which forms the product reservoir.

Preferably, the elastically deformable component may include a sponge or a foam, the size of the open or semi-open cells of which may be from approximately 0.1 mm to approximately 2.5 mm.

Preferably, the foam or the sponge is hydrophilic, such as polyurethane, viscose or polyester sponges or foams. Thus, the section of hair may be slipped gently between the edges of the slot. In certain cases, depending on the nature of the product to be applied and of the section of hair, it may prove to be advantageous to use a hydrophobic foam or sponge, such as polyethylene, polypropylene or polyether sponges.

Advantageously, the application device includes a resealable hole or passage which can be closed off so as to allow the reservoir to be filled with the product. Preferably, this hole is made in the enclosure.

The enclosure may, for example, be made by molding a relatively rigid thermoplastic chosen from polyethylenes, polypropylenes, polystyrenes, polyvinyl chlorides, polyethylene terephthalates, etc. Other materials may also be used. Such an enclosure may be molded in two or three pieces, advantageously without a reverse taper. Advantageously, it is made of a transparent material, thereby making it possible to check the fill level of the product in the reservoir.

Advantageously, the application device of the invention may further include a grip, such as an elongate handle.

A structure may be provided to immobilize the component made of elastically deformable material in the enclosure. Advantageously, the component made of elastically deformable material is immobilized in the enclosure by pinching, using one (or two) fitted lids to close off the enclosure. Such pinching may be achieved, for example, by use of one or more notches or sharp edges placed on the lid(s) or a portion of the enclosure, in contact with the lid(s). The lid(s) may be fixedly or removably mounted.

The application device of the invention may further include a mount to allow the applicator device to be mounted on a container forming an auxiliary reservoir. This mount connects the applicator device to an auxiliary reservoir containing a relatively large amount of product. In this case, the auxiliary reservoir can be brought, permanently or selectively, into communication with the reservoir. The container may have at least one deformable wall, making it possible, by compression, to transfer a dose of product into the product reservoir of the applicator device. The auxiliary container, when it is fastened to the enclosure, may serve as a grip.

Another aspect of the invention provides a method for applying a hair product, for example a dye product, to sections of hair, the method comprising isolating a section of hair to be coated with the product, passing the isolated section through a slot at least partly bounded by a component made of at least one elastically deformable material, the component at least partly defining a reservoir for the product with which the slot is in communication, wherein the slot opens onto the outside of an application device and is bounded by two edges which, at rest, are substantially contiguous over at least one portion of the slot so as to create a seal, and moving the elastically deformable component in a longitudinal direction with respect to the section.

According to one aspect, the present invention includes an applicator device. The applicator device includes a component formed of at least one elastically deformable material, a reservoir for a product, a slot in communication with the reservoir, the slot being at least partially defined by the component and being accessible from an outside of the device, the slot being bounded by edges configured to be placed in a substantially contiguous position so as to create a seal, wherein the slot is configured to permit a section of hair to pass through the slot and become coated with product in response to movement of the device in a longitudinal direction with respect to the section of hair.

According to another aspect of the invention, a product application system is provided. The product application system includes an auxiliary reservoir and the applicator device.

According to a further aspect of the invention, another method of applying a hair product to at least one section of hair is provided. The method includes selecting a section of hair to be coated with the product, passing the selected section of hair through a slot defined at least partially by substantially contiguous edge portions, the slot being at least partly bounded by a component formed of at least one elastically deformable material, the component at least partly defining a reservoir containing a product, and the slot being in communication with the reservoir, and moving the component in a longitudinal direction with respect to the section of hair to transfer the product to the section of hair.

According to yet another embodiment of the present invention, the applicator device includes an elastically deformable component, a reservoir for the product, the reservoir being positioned in the elastically deformable component and being in fluid communication with at least a portion of the elastically deformable component, and a slot at least partially defined by the elastically deformable component, the slot being bounded by edges and being configured to receive a section of hair between the edges.

According to another aspect of the invention, the method of applying includes providing the applicator wherein the reservoir contains a product, passing a section of hair through the slot, and moving the device longitudinally with respect to the section of hair to transfer product from the device to the section of hair.

It is to be understood that both the foregoing general description and the following detailed description are exemplary and explanatory only and are not restrictive of the invention, as claimed.

The accompanying drawings, which are incorporated in and constitute a part of this specification, illustrate several embodiments of the invention and together with the description, serve to explain the principles of the invention.

Reference will now be made in detail to the present preferred embodiments of the invention, examples of which are illustrated in the accompanying drawings. Wherever possible, the same reference numbers will be used throughout the drawings to refer to the same or like parts.

FIGS. 1 to 5, to which reference is now made, illustrate various views of a first preferred embodiment of the application device 1 according to the invention.

Figure 1:
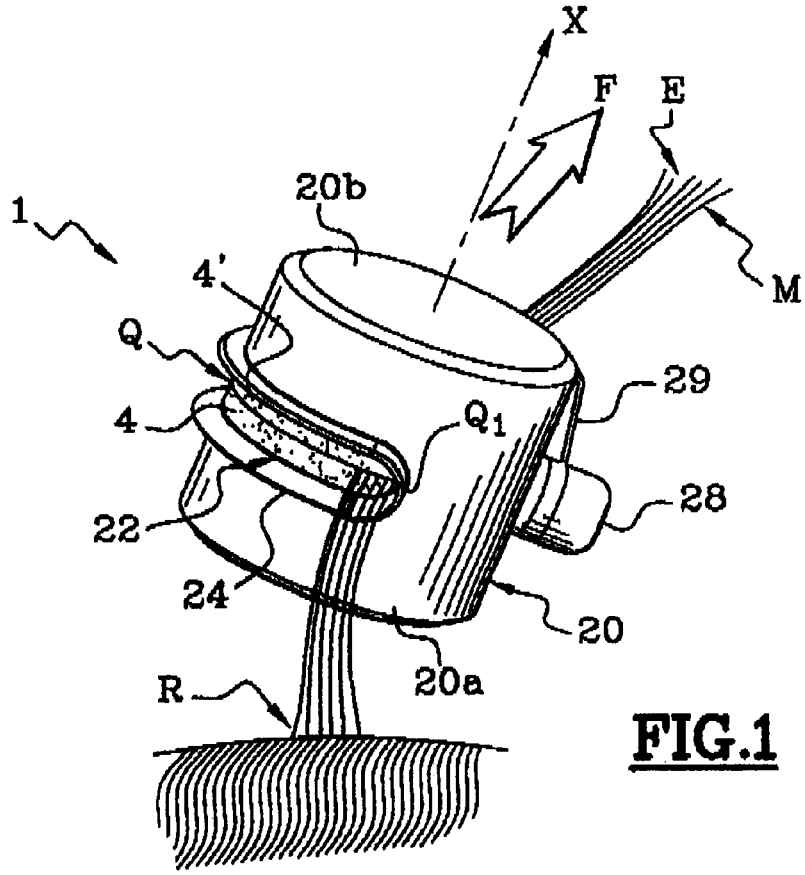
FIG. 1 depicts a perspective view of a first embodiment of the application device according to the invention, illustrated during use.
Figure 2:
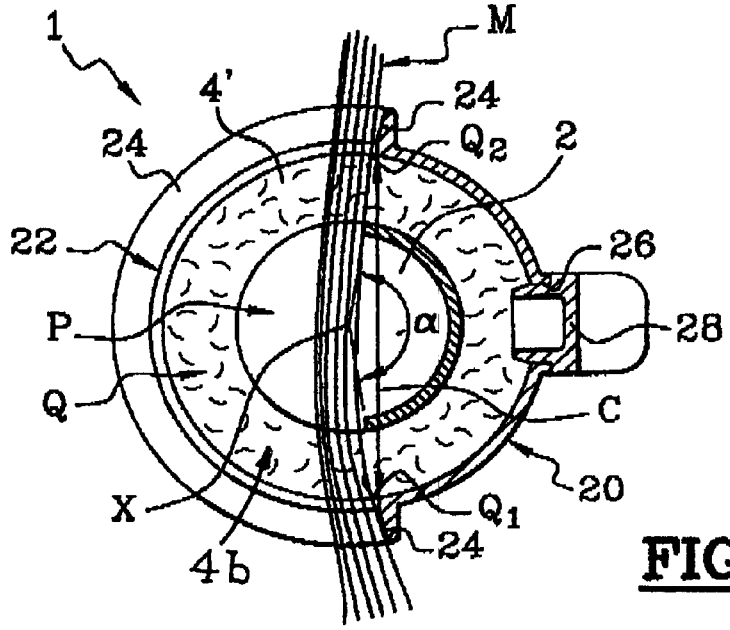
FIG. 2 shows a schematic cross-sectional view of the device depicted in FIG. 1.

FIGS. 1 and 2 show an isolated section M of hair, passing between two edges 4, 4' of a slot Q with which the application device 1 is provided. The two edges 4, 4' are each formed from a transverse portion of a cylinder made of a cellular foam having open or semi-open cells. The cylinder is axisymmetric about an axis X. The cylinder is hollowed out at its center and includes a stack of two foam blocks 4*a,* 4*b,* stacked along the axis X. According to the illustrative example shown in FIGS. 1–5, each of the two foam blocks 4*a,* 4*b* is made of the same type of elastically deformable foam.

It may be seen that the two blocks 4*a,* 4*b* forming the foam cylinder are at least partially separated at their interface by the slot Q perpendicular to the axis X and having an opening angle $\alpha$ slightly greater than 180°. The slot Q is substantially contiguous and is bounded by two ends $Q_1$ and $Q_2$ so that the chord C joining the ends of the slot passes approximately through the centre of a reservoir 2. The foam cylinder 4*a,* 4*b* comprises, for example, a hydrophilic foam such as a polyurethane foam having cells with a mean size of approximately 1.5 mm. The hollowed-out central part of the cylinder forms a reservoir 2 for the product P, of liquid consistency, especially a hair dye composition.

The foam blocks 4*a,* 4*b* are placed in a rigid enclosure or capsule 20, of cylindrical overall shape, including a part 20*a* forming a receptacle with a closed bottom and of a lid 20*b*. The lid is fixed, for example, by snap-fastening, to the open end of the receptacle 20*a*.

The capsule 20 has an opening 22 of elongate shape, so as to expose the slot Q and define the ends $Q_1$, $Q_2$ of the slot Q. Thus, the opening 22 is oriented in a plane perpendicular to the axis X. The opening 22 is bordered by a slightly flared guiding lip 24 intended to favour the introduction of the section M into the slot Q and to prevent the hair from being damaged when moving the application device.

The capsule 20 is provided with a filling hole 26 which can be closed off by a removable plug 28. The plug 28 is joined to the body of the capsule 20 by a flexible strip 29, in order to avoid losing the plug.

The filling hole 26 is used for fitting into the capsule 20 the dispensing nozzle of an external auxiliary reservoir having a large volume of product. The filling hole 26 allows a suitable dose of the product to be introduced into the reservoir 2. The external reservoir may be fitted into the hole 26 permanently or temporarily.

To use the device that has just been described, a section of hair M to be treated is separated from the rest of the hair. The user then takes hold of the device 1 prefilled with product P in one hand.

Next, by passing through the opening 22 in the capsule, a portion of the section of hair M is introduced into the slot Q, where it is sandwiched between the foam edges 4, 4' defining the slot Q. Thus, the section of hair M portion lies in a region extending substantially between the two ends $Q_1$ and $Q_2$ of the slot Q, near the chord C. In this way, the portion of the section of hair M, elastically trapped between the edges 4, 4' passes through the reservoir 2 so as to be in contact with the product P. The user, by moving the application device 1 from the root R of the section as far as its free end E, along the direction of the arrow F in FIG. 1, can impregnate all or part of the section of hair M with the product P, and do so throughout the depth of the section of hair M. This operation may also be carried out in the opposite direction, i.e., from free end E to root R. This process is repeated, section by section, as many times as desired. This entire operation is performed under clean conditions.

Thus, with the application device according to the invention it is clear that the treated section of hair M is completely controlled and held throughout its treatment. At the end of the movement, that is to say when the applicator arrives at the end of the section, the applicator is carefully rested against the rest of the hair. In the case of a dye product, its viscosity is advantageously such that the product cannot migrate significantly towards the other parts of the hair which are not treated, so as not to spoil the aesthetic appearance of the application thus carried out.

It will be noted that the product may have a low viscosity without any risk of leakage out of the reservoir, whatever the position in which the device is held by the user during the treatment. This is because the pressure between the edges 4, 4' is chosen so that the section can emerge from the slot Q correctly wiped of excess product P.

Advantageously, the opening 22, the capsule 20 and the lid 206 are produced by molding, preferably from a relatively rigid thermoplastic such as polyethylene or polypropylene. This material may be transparent, thus making it possible to verify the filling level of product in the reservoir 2.

Figure 3:
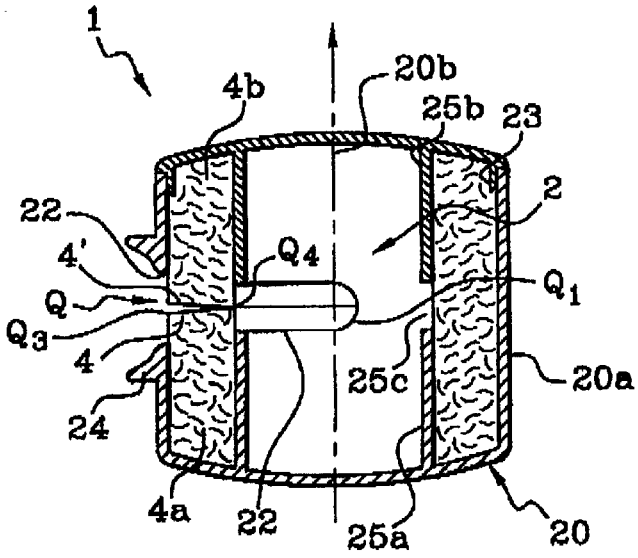
FIGS. 3 to 5 show various views according to the embodiment of FIGS. 1 and 2.
Figure 4:
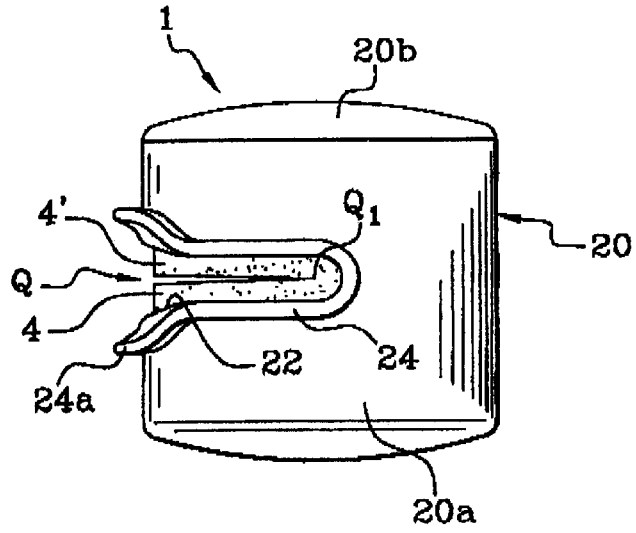
Figure 5:
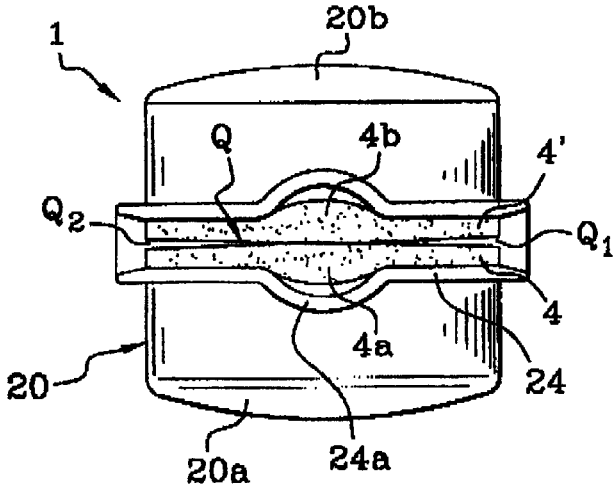

For the sake of simplification, in FIGS. 3 to 5 the filling hole of the device 1 has not been depicted. These figures show, in greater detail, various aspects of the embodiment described above.

FIG. 3 shows that the foam blocks 4*a,* 4*b* are held in the capsule 20 by skirts 25*a* and 25*b* concentric with the outer cylindrical wall of the capsule 20. These skirts 25*a* and 25*b* are carried by the receptacle 20*a* and the lid 20*b,* respectively. The skirts have a height such that an annular space is formed, allowing the product P contained in the reservoir 2 to come into contact with the foam.

The foam blocks 4*a,* 4*b* may be elastically compressed axially. The degree of compression is chosen so that the slot Q is sealed just enough to prevent the product P from flowing out of the reservoir 2. At the same time, a portion of the section of hair M, on which it is desired to apply the product P, is preferably able to be introduced easily. After treatment, the section of hair M leaves the slot correctly wiped.

FIGS. 4 and 5 show side and front views, respectively, of the device of FIG. 3. These figures show that the slot Q is slightly flared around its periphery $Q_3$, thus favouring the introduction of the section of hair to be treated into the reservoir 2. In the part $Q_4$ surrounding the reservoir 2, the slot Q is substantially contiguous. The opening 22 made in the capsule 20 is bordered by a projecting guiding lip 24. The profile of this lip 24 converges on the slot Q (see also FIG. 3). The lip 24 has a central portion 24*a* which defines a preferred introduction region of greater width.

Figure 6:
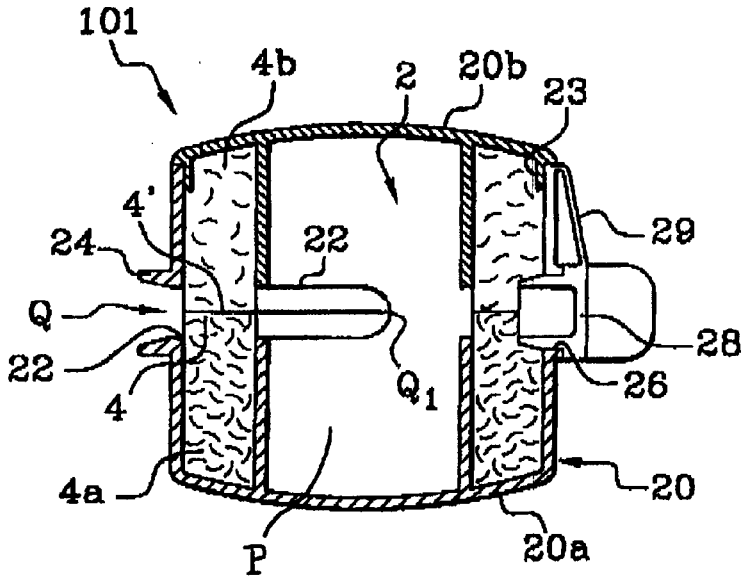
FIGS. 6 and 7 show axial sectional views of two other embodiments of the device according to the invention.

FIG. 6 shows an embodiment 101 similar to the embodiment in FIGS. 1 and 2. The capsule 20 in FIG. 6 is identical to that in FIGS. 1 and 2. The embodiment in FIG. 6 is distinguished from that in FIGS. 1 and 2 by the fact that the foam blocks 4*a* and 4*b* are of different types of materials. Thus, the block 4*a* is formed from a foam in which the size of the cells and/or the compressibility and/or the constituent material are different from the foam forming the block 4*b*.

Figure 7:
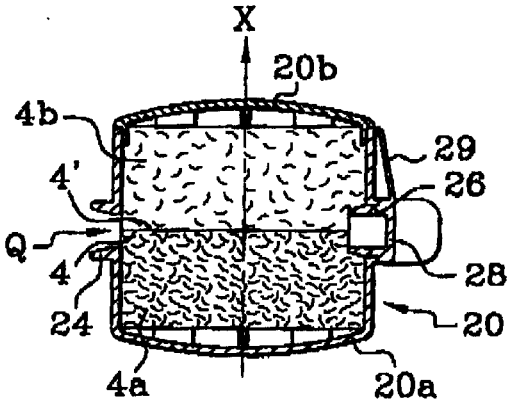

As may be seen in FIG. 7, the foam blocks 4*a,* 4*b* form a solid cylinder. According to the example shown in FIGS. 6 and 7, the blocks 4*a* and 4*b* are each formed from a foam of different type. The reservoir 2 containing the product P to be applied is formed in this case by the open cells of the blocks 4*a* and 4*b*.

Figure 8:
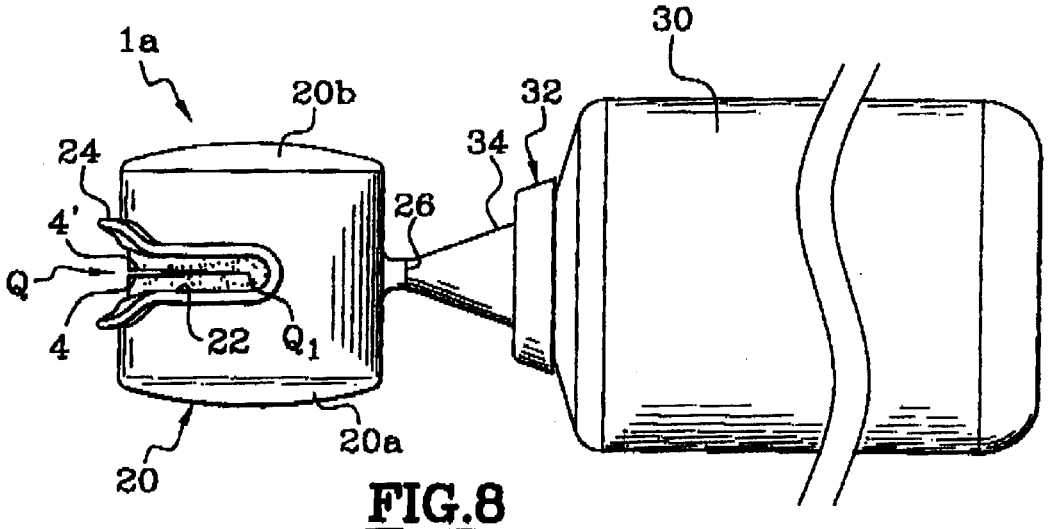
FIGS. 8 and 9 show perspective views of two further embodiments of the device according to the invention.

FIG. 8 shows an application device 1*a,* comprising a capsule 20 similar to that illustrated in FIGS. 1 and 2. According to the embodiment shown, an external auxiliary product reservoir 30 is fitted into the filling hole 26 of the capsule 20. This external reservoir 30 is preferably formed from a compressible bottle, made for example of a suitable thermoplastic, such as polyethylene, and capable of containing a large amount of product. The reservoir 30 is surmounted by a dispensing nozzle 32 provided with an adapter 34 capable of communicating with the filling hole 26. In the configuration illustrated, the external reservoir 30 and the capsule 20 (which is provided with application means 4, 4' and the reservoir) form a fixed application assembly, which can be supplied with product by the user at any time. Thus, by compressing the external reservoir 30, the user can inject a dose of product P into the capsule 20, for the purpose of replenishing the impregnation of the edges 4, 4' of the slot. In this case, the external reservoir 30 also serves as a gripping component during application of the product.

Figure 9:
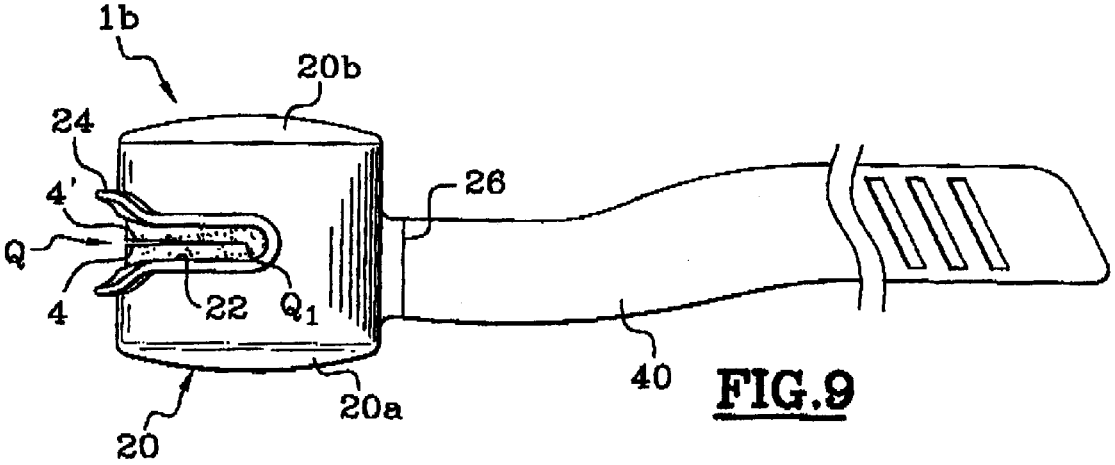

FIG. 9 illustrates an application device 1*b,* which includes a capsule 20 similar to that illustrated in FIGS. 1 and 2. In the embodiment shown, a gripping handle 40 is fitted into the filling hole 26 of the capsule 20. The handle 40 may be removable, in order to make it possible to introduce, through the filling hole, a dose of product into the capsule 20. After filling, the handle 40 is attached to the capsule so as to close off the said filling hole 26.

Figure 10:
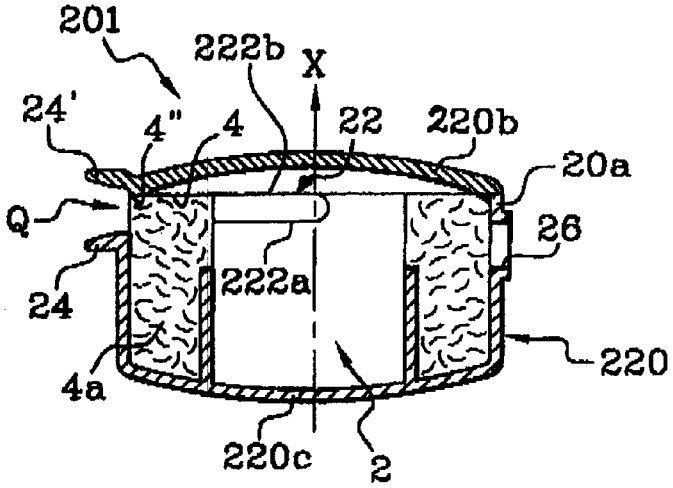
FIGS. 10 and 11 illustrate axial sectional views of two more embodiments of the invention.

FIG. 10 illustrates another embodiment, which is particularly simple to realize, of an application device 201. According to this embodiment, a capsule 220 is formed from a bowl-shaped lower receptacle 220*c* and a lid 220*b*. The receptacle 220*c* has substantially the same structure as the lower half of the capsule 20 in FIG. 3. A single hollow foam cylinder 4*a* is placed inside the capsule 220. The foam cylinder 4*a* forms an application surface 4 in elastic and sealed contact with a rigid portion 4" of the lid. Thus, a contiguous slot Q is formed between the foam surface 4 and the portion 4" of the edge of the lid 220*b*. Advantageously, the lid 220*b* has an outwardly domed internal profile. Thus, when a section of hair M is introduced into the slot Q, so as to pass through the reservoir 2, the product P contained in the reservoir 2 can impregnate the section of hair homogeneously.

A portion 222*a* of the receptacle 220*c* of the capsule is hollowed out so as to form, with a corresponding region 222*b* of the lid 220*b*, an elongate opening 22 oriented at right angles to the axis X. The opening 22 is bordered around its entire periphery by a two-part guiding lip, a first part 24 of which is integral with the receptacle 220*c* and a second part 24' of which is integral with the lid 220*b*.

Figure 11:
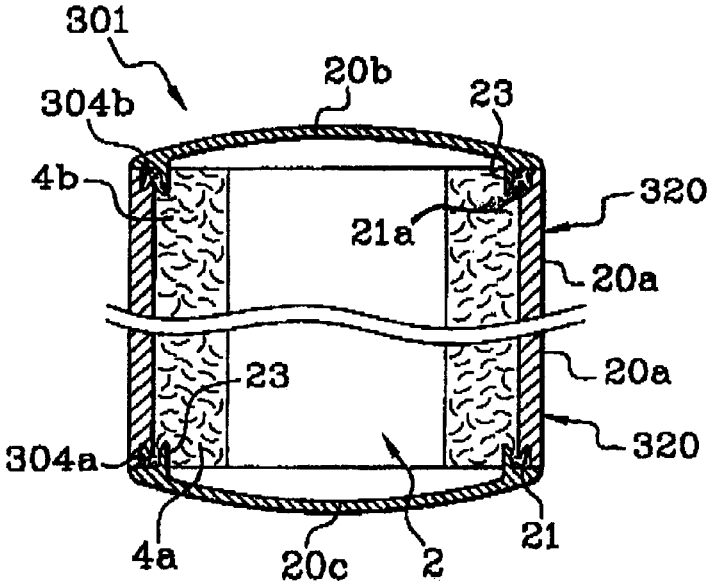

According to a preferred embodiment, FIG. 11 shows, in a partial view, a device 301 illustrating the mounting of a foam cylinder of two parts 4*a*, 4*b* inside a capsule 320. The capsule 320 has a cylindrical body 20*a* open at each end, each end being closed by a corresponding lid 20*b*, 20*c* of identical shape. The lids 20*b*, 20*c* each have an annular sealing skirt 23, the outside diameter of which is slightly less than the inside diameter of the body 20*a*. Each free end of the body 20*a* has an annular portion of smaller thickness, so as to define an internal projection 21. The internal projection 21 has a sharp annular edge 21*a* oriented towards the corresponding lid 20*b*, 20*c*. This sharp annular edge 21*a* may be continuous or discontinuous.

When assembling the capsule 320, the foam cylinder 4*a*, 4*b* is placed inside the body 20*a*. Next, by fitting each of the lids 20*b* and 20*c* to the corresponding end of the body 20*a*, for example by snap-fastening, adhesive bonding or press fitting, an annular foam portion 304*a*, 304*b* is pinched between the sharp edge 21*a* and the annular skirt 23.

It should be clearly understood that, when the foam cylinder 4*a*, 4*b* is made as a single piece it is sufficient to fasten it to only one of its ends. In this case, the second lid, on the opposite side from that serving for fastening the foam, may be removable. Thus, the second lid may serve as a plug which is removed in order to introduce the product into the reservoir 2 and which is refitted again after filling.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. An applicator device for applying a product to at least one section of hair, said device comprising:

a component formed of at least one elastically deformable material;

a reservoir for a product;

a hair dye associated with the reservoir;

a slot in communication with the reservoir, the slot being at least partially defined by said component and being accessible from an outside of the device, said slot being bounded by edges configured to be placed in a substantially contiguous position so as to create a seal without application of pressure by a user of the device, wherein the slot is configured to permit a section of hair to pass through the slot and become coated with product in response to movement of the device in a longitudinal direction with respect to the section of hair.

2. The applicator device of claim 1, wherein the component is configured such that the section of hair passing through the slot also passes through the product reservoir.

3. An applicator device for applying a product to at least one section of hair, said device comprising:

a component formed of at least one elastically deformable material;

a reservoir for a product;

a hair dye associated with the reservoir; and a slot in communication with the reservoir, the slot being at least partially defined by said component and being accessible from an outside of the device, said slot being bounded by edges configured to be placed in a substantially contiguous position so as to create a seal, wherein the slot is configured to permit a section of hair to pass through the slot and become coated with product in response to movement of the device in a longitudinal direction with respect to the section of hair, and wherein two of the edges of the slot are formed by the component.

4. The applicator device of claim 3, wherein one edge of the slot is formed by a first part of the component, the other edge of the slot being formed by a second part of the component formed of a second elastically deformable material.

5. The applicator device of claim 1, wherein the at least one elastically deformable material is chosen from: ethylene-propylene copolymers; polyether-block-amides; polyvinyls; ethylene-propylene-diene terpolymers (EPDM); styrene-butadiene-styrene block copolymers (SBS); styrene-ethylene butylene-styrene/styrene-isoprene-styrene block copolymers (SEBS-SIS); thermoplastic polyurethanes; blends of polypropylene with styrene-ethylene butylene-styrene/styrene-isoprene-styrene block copolymers (SEBS-SIS); blends of polypropylene with ethylene-propylene-diene terpolymers (EPDM); and blends of polypropylene with styrene-butadiene-styrene block copolymers (SBS).

6. An applicator device for applying a product to at least one section of hair, said device comprising:

a component formed of at least one elastically deformable material;

a reservoir for a product;

a hair dye associated with the reservoir; and a slot in communication with the reservoir, the slot being at least partially defined by said component and being accessible from an outside of the device, said slot being bounded by edges configured to be placed in a substantially contiguous position so as to create a seal, wherein the slot is configured to permit a section of hair to pass through the slot and become coated with product in response to movement of the device in a longitudinal direction with respect to the section of hair, and wherein the slot extends over an opening angle of from 20° to 320°.

7. The applicator device of claim 6, wherein the slot extends over an opening angle of from 120° to 200°.

8. An applicator device for applying a product to at least one section of hair, said device comprising:

a component formed of at least one elastically deformable material;

a reservoir for a product;

a hair dye associated with the reservoir; and a slot in communication with the reservoir, the slot being at least partially defined by said component and being accessible from an outside of the device, said slot being bounded by edges configured to be placed in a substantially contiguous position so as to create a seal, wherein the slot is configured to permit a section of hair to pass through the slot and become coated with product in response to movement of the device in a longitudinal direction with respect to the section of hair, and wherein the edges of the slot are flared with respect to one another to define an open portion configured to facilitate insertion of the section of hair into the slot.

9. An applicator device for applying a product to at least one section of hair, said device comprising:

a component formed of at least one elastically deformable material;

a reservoir for a product, the reservoir being at least partly bounded by a hollowed-out portion of the component;

a hair dye associated with the reservoir; and a slot in communication with the reservoir, the slot being at least partially defined by said component and being accessible from an outside of the device, said slot being bounded by edges configured to be placed in a substantially contiguous position so as to create a seal, wherein the slot is configured to permit a section of hair to pass through the slot and become coated with product in response to movement of the device in a longitudinal direction with respect to the section of hair.

10. An applicator device for applying a product to at least one section of hair, said device comprising:

a component formed of at least one elastically deformable material, the component being a hollowed-out cylinder having a center portion;

a reservoir for a product, the reservoir being at least partially formed by the center portion of the hollowed-out cylinder of the component, and a slot in communication with the reservoir, the slot being at least partially defined by said component and being accessible from an outside of the device, said slot being bounded by edges configured to be placed in a substantially contiguous position so as to create a seal, wherein the slot is configured to permit a section of hair to pass through the slot and become coated with product in response to movement of the device in a longitudinal direction with respect to the section of hair.

11. The applicator device of claim 1, wherein the product reservoir is located inside the component.

12. The applicator device of claim 11, wherein the elastically deformable material includes at least one of open and semi-open cells intercommunicating multidirectionally.

13. The applicator device of claim 12, wherein each of said at least one open and semi-open cells has a maximum dimension of from 0.1 mm to 2.5 mm.

14. The applicator device of claim 11, wherein the component is a solid cylinder.

15. An applicator device for applying a product to at least one section of hair, said device comprising:

a component formed of at least one elastically deformable material;

a reservoir for a product;

a hair dye associated with the reservoir;

a slot in communication with the reservoir, the slot being at least partially defined by said component and being accessible from an outside of the device, said slot being bounded by edges configured to be placed in a substantially contiguous position so as to create a seal without application of pressure by a user of the device, wherein the slot is configured to permit a section of hair to pass through the slot and become coated with product in response to movement of the device in a longitudinal direction with respect to the section of hair; and a resealable passage configured to allow the reservoir to be filled with the product.

16. The applicator device of claim 1, further comprising a grip.

17. An applicator device for applying a product to at least one section of hair, said device comprising:

a component formed of at least one elastically deformable material;

a reservoir for a product;

a hair dye associated with the reservoir;

a slot in communication with the reservoir, the slot being at least partially defined by said component and being accessible from an outside of the device, said slot being bounded by edges configured to be placed in a substantially contiguous position so as to create a seal without application of pressure by a user of the device, wherein the slot is configured to permit a section of hair to pass through the slot and become coated with product in response to movement of the device in a longitudinal direction with respect to the section of hair; and a mount configured to allow mounting of the applicator device on an auxiliary reservoir.

18. The applicator device of claim 1, wherein the reservoir is at least partly defined by the component.

19. A product application system comprising:

an auxiliary reservoir; and the applicator device of claim 1, the applicator device being configured to provide flow communication between the reservoir of the applicator device and the auxiliary reservoir.

20. The product application system of claim 19, wherein the auxiliary reservoir is one of permanently and selectively placed into communication with the product reservoir.

21. The product application system of claim 19, wherein the auxiliary reservoir includes at least one deformable wall.

22. The product application system of claim 19, wherein the hair dye is contained in the auxiliary reservoir.

23. The applicator device of claim 1, wherein the hair dye is contained in the reservoir.

24. An applicator device for applying a product to at least one section of hair, said device comprising:

a component formed of at least one elastically deformable material;

a reservoir for a product;

a hair dye associated with the reservoir; and a slot in communication with the reservoir, the slot being at least partially defined by said component and being accessible from an outside of the device, said slot being bounded by edges configured to be placed in a substantially contiguous position so as to create a seal without application of pressure by a user of the device, wherein the slot is configured to permit a section of hair to pass through the slot and become coated with product in response to movement of the device in a longitudinal direction with respect to the section of hair, and wherein the slot is bounded by two of the edges.

25. The applicator device of claim 24, wherein when the slot is in the substantially contiguous position, the edges are substantially contiguous over at least one portion of the slot.

26. An applicator device for applying a product to at least one section of hair, said device comprising:

a component formed of at least one elastically deformable material;

a reservoir for a product;

a hair dye associated with the reservoir; and a slot in communication with the reservoir, the slot being at least partially defined by said component and being accessible from an outside of the device, said slot being bounded by edges configured to be placed in a substantially contiguous position so as to create a seal, wherein the slot is configured to permit a section of hair to pass through the slot and become coated with product in response to movement of the device in a longitudinal direction with respect to the section of hair, and wherein the component is configured to bias at least one of the edges toward the substantially contiguous position.

27. A method of applying a product to at least one section of hair, comprising:

providing the applicator device of claim 1, wherein the reservoir contains a product;

passing a section of hair through the slot; and moving the device longitudinally with respect to the section of hair to transfer product from the device to the section of hair.

28. The method of claim 27, wherein the product transferred to the section of hair is a hair dye.

29. The method of claim 27, further comprising passing the product from an auxiliary reservoir to the reservoir of the applicator device.

30. A method of applying a hair product to at least one section of hair, the method comprising:

selecting a section of hair to be coated with the product;

passing the selected section of hair through a slot defined at least partially by substantially contiguous edge portions configured to create a seal without application of pressure by a user of the device, the slot being at least partly bounded by a component formed of at least one elastically deformable material, the component at least partly defining a reservoir containing a product, and the slot being in communication with the reservoir; and moving the component in a longitudinal direction with respect to the section of hair to transfer the product to the section of hair.

31. The method of claim 30, wherein the product transferred to the section of hair is a hair dye.

32. The method of claim 30, further comprising passing product from an auxiliary reservoir to the reservoir.

33. An applicator device for applying a product to at least one section of hair, comprising:

an elastically deformable component;

a reservoir for the product, the reservoir being positioned in the elastically deformable component and being in fluid communication with at least a portion of the elastically deformable component;

a hair dye associated with the reservoir;

a slot at least partially defined by the elastically deformable component, the slot being bounded by edges and being configured to receive a section of hair between the edges; and an enclosure, the elastically deformable component being positioned in the enclosure.

34. The applicator device of claim 33, wherein the elastically deformable component is formed of an elastically deformable material having at least one of open cells and semi-open cells.

35. The applicator device of claim 34, wherein at least some of the cells of the elastically deformable component are in fluid communication with the reservoir.

36. The applicator device of claim 34, wherein the cells of the elastically deformable component form at least part of the reservoir.

37. The applicator device of claim 33, wherein the elastically deformable component includes a first block formed of a first elastically deformable material and a second block formed of a second elastically deformable material.

38. The applicator device of claim 37, wherein the slot is defined by the first and second blocks of material.

39. An applicator device for applying a product to at least one section of hair, comprising:

an elastically deformable component, the elastically deformable component being a hollow cylinder;

a reservoir for the product, the reservoir being positioned in the elastically deformable component and being in fluid communication with at least a portion of the elastically deformable component; and a slot at least partially defined by the elastically deformable component, the slot being bounded by edges and being configured to receive a section of hair between the edges.

40. The applicator device of claim 39, wherein the reservoir is in the hollow cylinder.

41. The applicator device of claim 35, wherein the elastically deformable component is configured such that the section of hair received by the slot is placed in fluid communication with the reservoir.

42. The applicator device of claim 33, wherein the edges bounding the slot are configured to be placed in a substantially contiguous position so as to create a seal.

43. A method of applying a product to at least one section of hair, comprising:

providing the applicator device of claim 33, wherein the reservoir contains a product;

passing a section of hair through the slot; and moving the device longitudinally with respect to the section of hair to transfer product from the device to the section of hair.

44. The method of claim 43, wherein the product transferred to the section of hair is a hair dye.

45. The method of claim 43, further comprising passing the product from an auxiliary reservoir to the reservoir of the applicator device.

46. A method of applying a product to at least one section of hair, comprising:

providing an applicator device comprising a component formed of at least one elastically deformable material, a reservoir containing a product, and a slot in communication with the reservoir, the slot being at least partially defined by said component and being accessible from an outside of the device, said slot being bounded by edges configured to be placed in a substantially contiguous position so as to create a seal without application of pressure by a user of the device, wherein the slot is configured to permit a section of hair to pass through the slot and become coated with product in response to movement of the device in a longitudinal direction with respect to the section of hair;

passing a section of hair through the slot; and moving the device longitudinally with respect to the section of hair to transfer product from the device to the section of hair.

47. A method of applying a product to at least one section of hair, comprising:

providing an applicator device comprising an elastically deformable component, a reservoir containing the product, the reservoir being positioned in the elastically deformable component and being in fluid communication with at least a portion of the elastically deformable component, a slot at least partially defined by the elastically deformable component, the slot being bounded by edges and being configured to receive a section of hair between the edges, and an enclosure, the elastically deformable component being positioned in the enclosure;

passing a section of hair through the slot; and moving the device longitudinally with respect to the section of hair to transfer product from the device to the section of hair.

48. The applicator device of claim 1, further comprising an enclosure formed of a material impermeable to the product, the component being disposed in the enclosure.

49. The applicator device of claim 48, wherein a portion of the enclosure defines one of the edges of the slot.

50. The applicator device of claim 48, wherein the enclosure includes an opening configured to permit access to the slot from the outside of the device.

51. The applicator device of claim 50, further comprising guiding members in the vicinity of the opening, the guiding members being configured to guide insertion of the section of hair into the device.

52. The applicator device of claim 48, further comprising an element configured to immobilize the component in the enclosure.

53. The applicator device of claim 52, wherein the component is immobilized in the enclosure by a fitted lid configured to pinch the component and close off the enclosure.

54. The applicator device of claim 48, wherein the enclosure is transparent.

* * * * *

UNITED STATES PATENT AND TRADEMARK OFFICE

CERTIFICATE OF CORRECTION

PATENT NO. : 6,626,599 B2
DATED : September 30, 2003
INVENTOR(S) : Vincent De Laforcade It is certified that error appears in the above-identified patent and that said Letters Patent is hereby corrected as shown below:

Column 14,
Line 31, change "claim 35" to -- claim 33 --.

Signed and Sealed this

Thirtieth Day of December, 2003

JAMES E. ROGAN
*Director of the United States Patent and Trademark Office*